US007331372B2

(12) United States Patent
Takizawa et al.

(10) Patent No.: US 7,331,372 B2
(45) Date of Patent: Feb. 19, 2008

(54) METHOD FOR MELTING METALLIC RAW MATERIAL IN METAL MOLDING APPARATUS

(75) Inventors: Kiyoto Takizawa, Nagano-ken (JP); Toshiyasu Koda, Nagano-ken (JP); Mamoru Miyagawa, Nagano-ken (JP); Kazuo Anzai, Nagano-ken (JP); Koji Takei, Nagano-ken (JP); Ikuo Uwadaira, Nagano-ken (JP); Ko Yamazaki, Nagano-ken (JP)

(73) Assignee: Nissei Plastic Industrial Co., Ltd., Nagano-ken (JP)

( * ) Notice: Subject to any disclaimer, the term of this patent is extended or adjusted under 35 U.S.C. 154(b) by 93 days.

(21) Appl. No.: 10/549,429

(22) PCT Filed: Feb. 24, 2005

(86) PCT No.: PCT/JP2005/003550

§ 371 (c)(1),
(2), (4) Date: Sep. 15, 2005

(87) PCT Pub. No.: WO2005/080025

PCT Pub. Date: Sep. 1, 2005

(65) Prior Publication Data

US 2006/0243414 A1 Nov. 2, 2006

(30) Foreign Application Priority Data

Feb. 25, 2004 (JP) ..... 2004-049975
Jun. 17, 2004 (JP) ..... 2004-179697

(51) Int. Cl.
*B22D 17/08* (2006.01)
*B22D 23/00* (2006.01)
*B22D 25/00* (2006.01)

(52) U.S. Cl. ..... 164/113; 164/900

(58) Field of Classification Search ..... 164/113, 164/312, 900

See application file for complete search history.

(56) References Cited

U.S. PATENT DOCUMENTS

| | | | | |
|---|---|---|---|---|
| 7,165,599 | B2 * | 1/2007 | Takizawa et al. | 164/312 |
| 2001/0020526 | A1 * | 9/2001 | Motegi et al. | 164/122 |
| 2003/0051851 | A1 * | 3/2003 | Yamada | 164/113 |

FOREIGN PATENT DOCUMENTS

| | | |
|---|---|---|
| JP | 2001-252759 | 9/2001 |
| JP | 2003-200249 | 7/2003 |

* cited by examiner

*Primary Examiner*—Kevin P. Kerns
(74) *Attorney, Agent, or Firm*—Weingarten, Schurgin, Gagnebin & Lebovici LLP

(57) ABSTRACT

To insert a cylindrical metallic raw material into a melting cylinder provided in a heating holding cylinder of a metal molding apparatus and to efficiently semi-melt or completely melt the cylindrical metallic raw material, a clearance between an inner circumferential surface of the melting cylinder and an outer circumferential surface of the cylindrical metallic raw material is limited to a range in which the clearance does not exceed 1.0 mm with respect to the inner diameter of the melting cylinder and the diameter of the metallic raw material during thermal expansion and the insertion of the metallic raw material in a non-thermal expansion state into the thermally expanding melting cylinder is possible, from a linear expansion coefficient of a metallic raw material and a linear expansion coefficient of a material of the melting cylinder.

12 Claims, 4 Drawing Sheets

METHOD FOR MELTING METALLIC RAW MATERIAL IN METAL MOLDING APPARATUS

This application is a §371 national phase filing of PCT/JP2005/003550 filed Feb. 24, 2005, and claims priority to Japanese application No. 2004-049975 filed Feb. 25, 2004, and to Japanese application No. 2004-179697 filed Jun. 17, 2004.

TECHNICAL FIELD

The present invention relates to a method for melting a metallic raw material in an apparatus for molding a metal, wherein the metallic raw material formed into a cylindrical shape by casting or extrusion is melted and injected into a mold so that a desired article is injection-molded.

BACKGROUND ART

As a molding means for a magnesium alloy or the like, a molding means is known in which it includes a heating means on the outer circumference of a cylindrical body having a nozzle opening at the end, a granular metallic raw material is supplied to a molten metal holding cylinder (heating holding cylinder) formed in an end portion by diameter-reducing a measuring chamber connected to the nozzle opening to melt the material and accumulate it, or molten metal melted by a melting furnace is supplied to a molten metal holding cylinder to accumulate it, so that the weighing of the molten metal and the injection into a mold by forward and backward movements of an injection plunger provided inside the molten metal holding cylinder (See, Japanese Laid-Open Patent Publication No. 2003-200249).

Further, as a method for casting a metallic article is known in which after a cylindrical metallic raw material cast by cooling a metal slurry is supplied into an injection device laterally to be preheated, the preheated material is heated in a semi-molten state to be accumulated in a heating chamber and the reserved material is injected into a mold by a suction rod (See, Japanese Laid-Open Patent Publication No. 2001-252759).

DISCLOSURE OF THE INVENTION

Problems to be Solved by the Invention

A granular metallic raw material is liable to be oxidized and is lightweight. Thus even if the material drops into the molten metal holding cylinder, the material slightly sinks into molten metal to melt immediately and most of the material floats and stacks on the surface of the molten metal and is exposed to hot air for long time. Accordingly, sludge is liable to be generated. The generation of this sludge can be suppressed by casting or extruding the granular metallic raw material into a cylindrical body form (also called as a round bar) having a lower degree of oxidation than a granular form.

However, the cylindrical metallic raw material cannot be directly supplied to a molten metal heating holding cylinder and it is supplied after being completely melted by a melting furnace or it is preheated by a preheating barrel and then heated in a semi-molten state to be accumulated in a heating chamber. Thus a metal molding apparatus becomes a large size and maintenance requires a lot of work.

The above-mentioned problems can be solved by adopting a cylindrical body as a melting means for the cylindrical metallic raw material, providing the melting cylinder in an injection means-integrated heating holding cylinder vertically and supplying the cylindrical metallic raw material to the heating holding cylinder in a semi-molten metal state or in a completely molten metal state while heating and melting the cylindrical metallic raw material inserted inside the melting cylinder from the circumference thereof.

Since such a metal molding apparatus is comprised of a heating holding cylinder and a melting cylinder, it does not have a large size and the maintenance becomes easy. However, since the melting of the cylindrical metallic raw material is indirectly performed by radiant heat of a heating means around the melting cylinder, the heating efficiency is worse than in case of a melting furnace, which directly heats the cylindrical metallic raw material by contact with molten metal through dropping of the material into the molten metal, and the melting takes much time.

A clearance between the melting cylinder and the cylindrical metallic raw material becomes a cause of the worse heating efficiency in this melting cylinder. The clearance has been set taking the easiness of insertion of the cylindrical metallic raw material into consideration and is set by determining the inner diameter of the melting cylinder from the diameter of the cylindrical metallic raw material before heating (at non-thermal expansion). Since in the setting of this inner diameter of the melting cylinder, the diameter of the cylindrical metallic raw material and the inner diameter of the melting cylinder have tolerances and the melting cylinder has a partially narrowed portion or the like in the inner diameter due to adhesion of an oxide, thus the clearance has been set by taking above-mentioned conditions into consideration. Consequently the clearance tends inevitably to be set at a large value.

In heating by radiant heat from the melting cylinder, it is impossible to heat a cylindrical metallic raw material from the bottom surface and the top surface thereof. Thus, the heating is limited to the body circumference of the cylindrical metallic raw material. Accordingly, taking much time until heating reaches the center portion of the cylindrical metallic raw material to become a melting temperature is also a main cause of worse heating efficiency in the cylindrical metallic raw material.

The heating efficiency by radiant heat in the melting cylinder becomes lower as the clearance (heating distance) is increased. When the clearance is set at a smaller value for improving the heating efficiency, the closer an outer surface of the cylindrical metallic raw material is brought to an inner surface of the melting cylinder, the more vertical the insertion of the cylindrical metallic raw material into the melting cylinder has to be made, and then drop-insertion by self weight to a bottom surface of the melting cylinder is troublesome. A delay of the supply of the metallic raw material due to the troubles of such inserting operation sometimes causes reduction of an accumulation amount of the metallic raw material in the heating holding cylinder and hinders a molding operation.

The object of the present invention is to provide a new method for melting a metallic raw material in a metal molding apparatus that can solve the above-mentioned problems concerning difficulties upon insertion of the metallic raw material formed cylindrically into a vertically provided melting cylinder and the heating efficiency by setting a clearance at the time of thermal expansion from each linear expansion coefficient of the metallic raw material and a material of the melting cylinder.

Further another object of the present invention is to provide a new method for melting a metallic raw material in a metal molding apparatus that can solve the problem of worse heating efficiency in the center portion of the cylindrical metallic raw material by simultaneously performing the heating of a body portion from a melting cylinder by radiant heat and the partial contact heating of the cylindrical metallic raw material from a bottom surface thereof, and also can suppress the generation of sludge by finishing of the metallic raw material.

Means for Solving the Problems

The object of the present invention is attained by a method for melting a metallic raw material in a metal molding apparatus comprising the steps of forming the metallic raw material into a cylindrical shape by casting or extrusion, inserting the cylindrical metallic raw material as a molding material into a melting cylinder provided vertically in a heating holding cylinder in the metal molding apparatus from above, and semi-melting or completely melting the cylindrical metallic raw material by a heating means set around the melting cylinder, wherein a clearance between an inner circumferential surface of the melting cylinder and an outer circumferential surface of the cylindrical metallic raw material is previously limited to a range in which the clearance does not exceed 1.0 mm with respect to the inner diameter of the melting cylinder and the diameter of the cylindrical metallic raw material during thermal expansion and the insertion of the cylindrical metallic raw material in a non-thermal expansion state into the thermally expanding melting cylinder at the temperature of the heating means is possible, from a linear expansion coefficient of a metallic raw material and a linear expansion coefficient of a metallic material adopted as the melting cylinder. Furthermore, the melting cylinder is made of a metallic material having a linear expansion coefficient smaller than a linear expansion coefficient of the metallic raw material.

Further, in the present invention, the melting cylinder is comprised of a funnel-shaped bottom portion connecting to a body portion of the melting cylinder, an outflow pipe having a smaller diameter than the body portion at the center of the bottom portion, an auxiliary heating member provided laterally in a lower portion of the body portion adjacent to the bottom portion of the melting cylinder, both ends of the auxiliary heating member being fixed to a body wall, and a heating means provided on the body portion and on an outer circumference of the outflow pipe, and the melting of the metallic raw material is performed by simultaneously heating of both radiant heat of the body circumference and contact heating of the bottom surface of the metallic raw material, by supporting partially the bottom surface of the cylindrical metallic raw material with the auxiliary heating member.

Moreover, a plurality of the auxiliary heating members are provided laterally cross at the center in a lower portion of the body portion adjacent to the bottom portion of the melting cylinder so that the bottom surface of the cylindrical metallic raw material is partially supported. Furthermore, a heating means is provided within the auxiliary heating member and the center portion of the cylindrical metallic raw material is directly heated from a bottom surface thereof by contact between the auxiliary heating member and the bottom surface of the cylindrical metallic raw material.

The metallic raw material of the present invention is made of a low melting metal alloy such as a magnesium alloy, an aluminum alloy or the like and the magnesium alloy exhibits thixotropic properties at a temperature in a solid-liquid coexisting temperature range. Besides, the melting of the metallic raw material is performed after cutting and removing cavities generated in a surface layer of the cylindrical metallic raw material and impurities adhered to a surface of the material.

Effects of the Invention

In the present invention, even if the clearance c during the thermal expansion of both the melting cylinder and the cylindrical metallic raw material is set at a range not exceeding 1 mm, since the cylindrical metallic raw material is in a non-thermal expansion state until it is heated, the clearance at the insertion of the cylindrical metallic raw material is formed larger than the clearance during the thermal expansion by a part of its non-thermal expansion. Therefore, even if the clearance during non-thermal expansion of both the melting cylinder and the cylindrical metallic raw material set based on the clearance during the thermal expansion has an extent close to the insertion limit for the cylindrical metallic raw material, the insertion of the cylindrical metallic raw material can be performed without any trouble. Further since the clearance is spontaneously changed into a narrow state by thermal expansion of an inserted metallic raw material, the heating efficiency is improved and the melting time is shortened, thus melting of the metallic raw material can be carried out according to the molding cycle, and the supply and accumulation of molten metallic raw material into the heating holding cylinder are effectively performed. Further even when the material of melting cylinder is changed, an appropriate clearance can be set from a linear thermal expansion coefficient of the material being used.

Further, according to the above-mentioned construction, since a bottom surface of the cylindrical metallic raw material is partially supported by an auxiliary heating member and is positioned on a funnel-shaped bottom portion, as the cylindrical metallic raw material is softened by heating from the outer circumference of the body portion of the material, the auxiliary heating member enters into the cylindrical metallic raw material from the bottom surface thereof due to a load thereof. Since the auxiliary heating member is heated by heat transfer from the body portion or by an embedded heating means, the cylindrical metallic raw material receives heating from the inside of the bottom surface and the heating efficiency is more improved together with heating from the circumference of the body than in a case where the circumference of the body is heated while supporting the entire bottom surface of the cylindrical metallic raw material with an inner bottom surface of the melting cylinder, so that melting time becomes shorter.

Consequently, the melt supply and accumulation of a metallic raw material corresponding to a molding cycle can be performed. Further, since cavities on a surface layer of a cylindrical metallic raw material and impurities of oxides and the like adhered to the surface are cut and removed and the cylindrical metallic raw material is melted in a melting cylinder, the generation of sludge of oxides is reduced. Thus, a period or time of periodic maintenance including avoidance of sludge can be lengthened and the production efficiency is improved due to reduction of the number of times of the maintenance. Further, rejected articles due to mixing of the sludge is remarkably reduced, thereby yield can be improved.

Further, since in a metallic raw material of a metal structure exhibiting thixotropic properties, a distribution state of an eutectic crystal melted at a solid-liquid coexisting temperature is not uniform, even if the metallic raw material is melted down from a cylindrical metallic raw material as a molten lump, the molten lump is melted again at a bottom portion in a melting cylinder having a funnel-shaped bottom portion. Therefore the molten lump does not prevent a melt from flowing out to the heating holding cylinder.

BEST MODE FOR CARRYING OUT THE INVENTION

Figure 1:
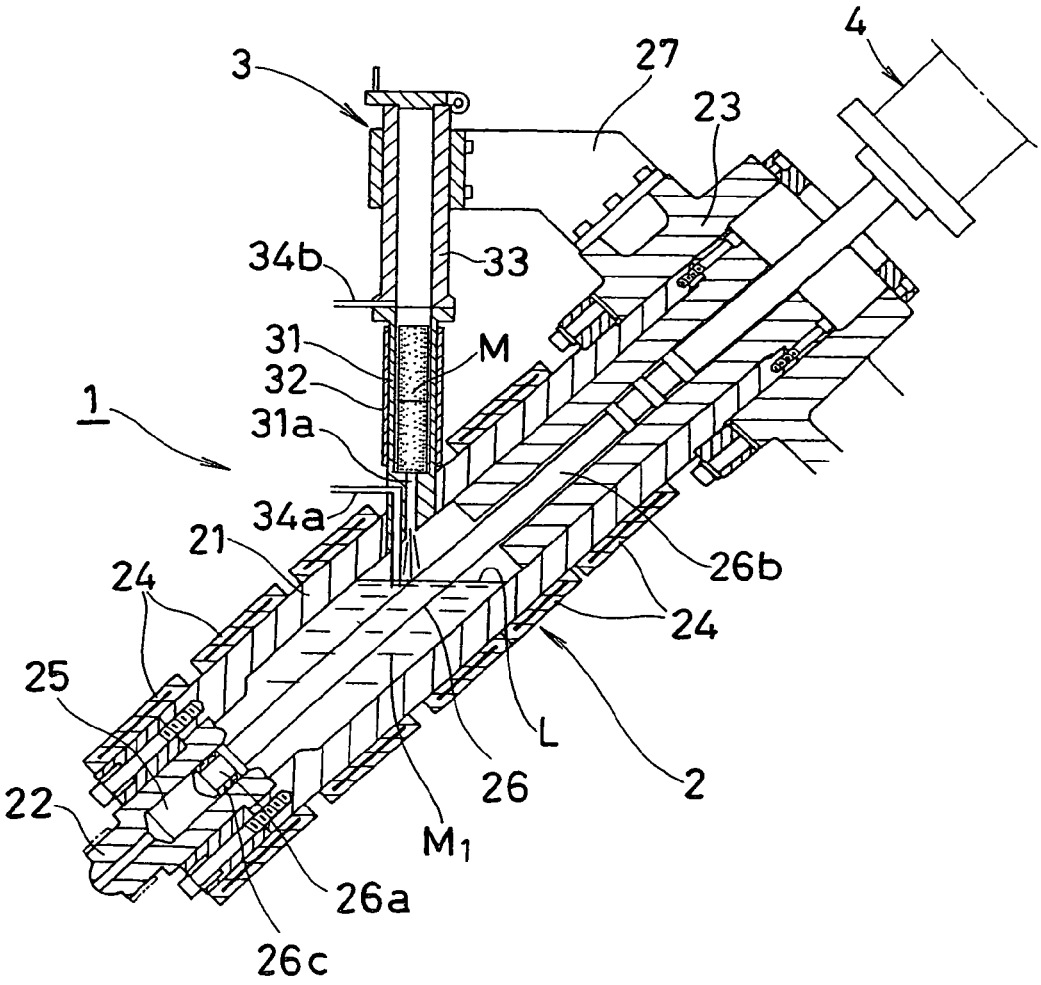
FIG. 1 is a vertical cross-sectional side view of an embodiment of a metal molding apparatus, which can adopt a method for melting a metallic raw material according to the present invention.

The reference numeral 1 in FIG. 1 denotes a metal molding apparatus. The metal molding apparatus 1 is comprised of a heating holding cylinder 2 having a nozzle member 22 at the end of a cylinder body 21, a melting supply device 3 for a metallic raw material M (hereinafter mentioned as cylindrical metallic raw material) formed into a cylindrical body (round bar) by casting or extrusion, and an injection drive 4 at a rear portion of the injection holding cylinder 2.

The heating holding cylinder 2 includes the melting supply device 3 in a supply opening provided on substantially the middle upper side of the cylinder body 21 and includes a heating means 24 of a band heater at the outer circumference of the cylinder body 21. In a case where the metallic raw material such as magnesium alloy and aluminium alloy used as molding material exhibits thixotropic properties at a temperature in a solid-liquid coexisting temperature region, a temperature of the heating holding cylinder 2 by this heating means 24 is set at a temperature between the liquidus temperature and the solidus temperature, and in a case where the metallic raw material is required to be completely melted, a temperature of the heating holding cylinder 2 is set at the liquidus temperature and higher.

The heating holding cylinder 2 is attached to a supporting member 23 at the rear end portion of the cylinder body in such a manner that it is provided slantingly at an angle of 45° with respect to the horizontal surface together with the injection drive 4. In this slanting arrangement of the heating holding cylinder 2, the inside of the front end portion communicating with a nozzle opening for the nozzle member 22 positioned downward is a measuring chamber 25 into which an injection plunger 26*a* of the injection means 26 is extendably and retractively insertion-fitted. The injection plunger 26*a* is attached to an end of a rod 26*b* and includes extendably and retractively a check valve 26*c* in an outer circumferential surface of which a seal ring is embedded, on the circumference of the shaft of the injection plunger 26*a*.

The melting supply device 3 is comprised of a melting cylinder 31 wherein the inside of an end of an elongated pipe body is closed to make a flat bottom portion and a small diametric supply passage 31*a* is bored at the center of the flat bottom portion, a heating means 32 such as a band heater or an induction heater, provided on the outer circumference of the melting cylinder 31 partitioned into a plurality of zones in temperature controllable individually, and a supply cylinder 33 vertically connected to an upper portion of the melting cylinder 31. The heating means 32 has been set at either one of the liquidus temperature and above or a temperature (solid-liquid coexisting temperature range) between the liquidus temperature or below and the solidus temperature or above.

Further, the melting supply device 3 is provided vertically on the heating holding cylinder 2 by inserting a bottom portion side of the melting cylinder 31 into a material supply opening provided in the cylinder body 21 and attaching the supply cylinder 33 to an arm member 27 provided fixedly on the supporting member 23. Further, a portion from a lower portion of the melting supply device 3 to the inside of the molten metal surface L of the heating holding cylinder 2, and a portion in upper space of the melting cylinder 31 are provided respectively with inert gas filling pipes 34*a* and 34*b* for argon gas or the like.

In such a melting supply device 3, when the cylindrical metallic raw material M is inserted through the upper opening of the supply cylinder 33, the cylindrical metallic raw material M drops by self weight to a bottom surface of the melting cylinder 31 in contact with the bottom. This cylindrical metallic raw material M is semi-melted or completely melted by radiant heat from the circumference of the melting cylinder 31. Molten metallic raw material flows down through the supply passage 31*a* to be accumulated in the heating holding cylinder 2. After that the molten metallic raw material flows into the measuring chamber 25 by the backward movement of the injection plunger 26*a* and is weighed. Then the molten metallic raw material is injected into a mold not shown by the forward movement of the injection plunger 26*a*.

Figure 2:
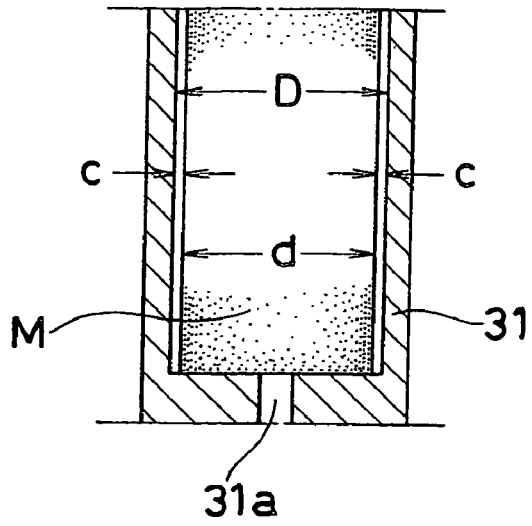
FIG. 2 is a partial cross-sectional view showing a clearance during heating expansion of a melting cylinder and a cylindrical metallic raw material.
Figure 3:
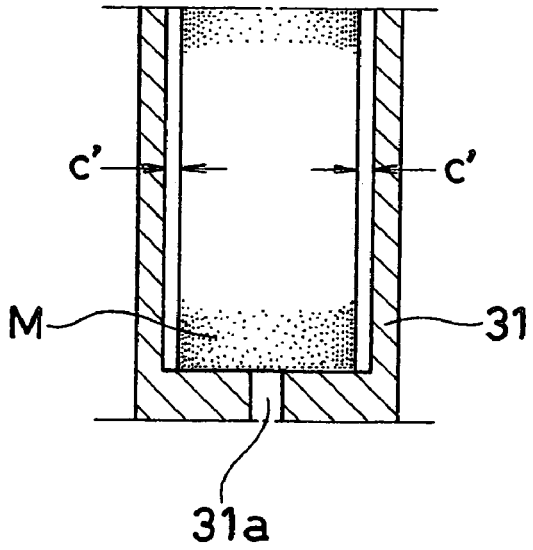
FIG. 3 is a partial cross-sectional view showing a clearance during non-thermal expansion of the melting cylinder and the cylindrical metallic raw material.

In FIGS. 2 and 3 a clearance c between an inner circumferential surface of the above-mentioned melting cylinder 31 and an outer circumferential surface of the cylindrical metallic raw material M is produced by the difference between an inner diameter D of the melting cylinder and a diameter d of the cylindrical metallic raw material M, and one half of the difference is defined as the clearance c. In general the clearance c is set during non-thermal expansion before both the melting cylinder and the cylindrical metallic raw material are subjected to heating taking the easiness of insertion of the cylindrical metallic raw material M into consideration. However, the smaller the clearance c is the higher the heating efficiency is. Thus, in this case the clearance is set during thermal expansion of both the melting cylinder 31 and the cylindrical metallic raw material M.

The setting of this clearance c is performed using the diameter d of the cylindrical metallic raw material M and the inner diameter D of the melting cylinder 31 during thermal expansion obtained by the linear thermal expansion coefficients of the metallic raw material and a metallic material adopted for the melting cylinder as the targets. In this case the thermal expansion temperature should preferably be applied at an upper limit temperature (at 550° C. for a magnesium alloy for example) at which a shape of the cylindrical metallic raw material M is maintainable and does not deform due to the thermal expansion. The narrower the clearance c is the higher the heating efficiency becomes. On the contrary when the clearance is too narrow the insertion of the cylindrical metallic raw material M becomes difficult. Accordingly, while taking the easiness of the insertion of the cylindrical metallic raw material M and heating efficiency into consideration the clearance c is set at a range which does not exceed 1.0 mm during thermal expansion of both the cylindrical metallic raw material M and the melting cylinder 31 and at which the clearance c at the time when the cylindrical metallic raw material M in a non-thermal expansion state is inserted into the melting cylinder 31 under thermal expansion is set not to exceed 1.5 mm. Further, in order to prevent an increase in the clearance c due to thermal expansion, a metallic material having a linear expansion coefficient smaller than the linear expansion coefficient of the metallic raw material is used as a metallic material of the melting cylinder 31.

Even if a clearance c' during non-thermal expansion of both the cylindrical metallic raw material M and melting cylinder 31 set based on this clearance c is a clearance smaller than the insertion limit (about 0.8 mm) of the cylindrical metallic raw material M due to an oxide stuck on the inner circumferential surface of the melting cylinder 31, since the cylindrical metallic raw material M has not been heated at the time of insertion of the cylindrical metallic raw material M, it has not been thermally expanded and a part of the non-thermal expansion of the cylindrical metallic raw material M makes the clearance c' large. Thus the insertion of the cylindrical metallic raw material M can be made without any trouble. Further, even if a difference between left and right clearances occurs due to insertion shift of the cylindrical metallic raw material, the difference is within a range of clearance not exceeding 1.0 mm and the difference does not impart significant influence to the heating efficiency. As a result the setting of a clearance where the heating efficiency is high and the insertion of the cylindrical metallic raw material M into the melting cylinder is smooth becomes possible. Even in the case that the melting of the cylindrical metallic raw material M is performed in the melting cylinder 31, the melting supply and accumulation of the metallic raw material according to a molding cycle can be made.

Figure 4:
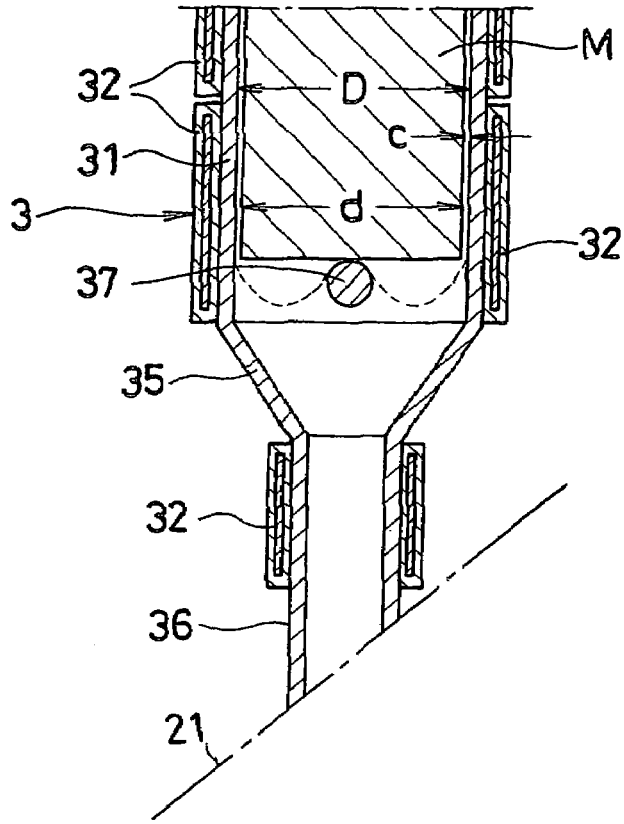
FIG. 4 is a lower portion longitudinal cross-sectional side view of the melting cylinder including an auxiliary heating member, which partially contact-heating the center portion of a bottom surface of the cylindrical metallic raw material.
Figure 5:
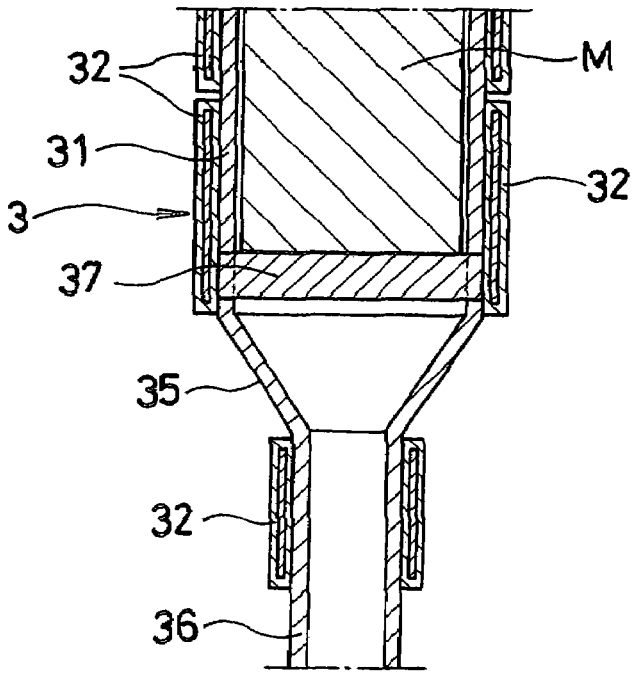
FIG. 5 is a lower portion longitudinal cross-sectional front view thereof.

A melting supply device 3 shown in FIG. 4 and the following is comprised of a melting cylinder 1, a funnel-shaped bottom portion 35 connecting to a body portion of the melting cylinder, a center outflow pipe 36 of the bottom portion 35 having a smaller diameter than the body portion, a laterally provided auxiliary heating member 37 of a stainless steel round bar, both ends of which are fixed to a body wall of the melting cylinder 1 in a lower portion of the body portion adjacent to the bottom portion 35, and a heating means 32 provided on an outer circumference of the body portion and the outflow pipe 36. In such a melting supply device 3, a bottom surface of the above-mentioned cylindrical metallic raw material M is partially supported by the auxiliary heating member 37 so that heating of the cylindrical metallic raw material M within the melting cylinder 31 by both radiant heat of the body circumference and contact heating from the bottom surface thereof can be simultaneously performed. Further, the heating means 32 for the melting cylinder 31 is divided into a plurality of zones from the lower side of the auxiliary heating member 37 to the upper portion thereof so that it is provided individually in temperature-controllable.

Figure 6:
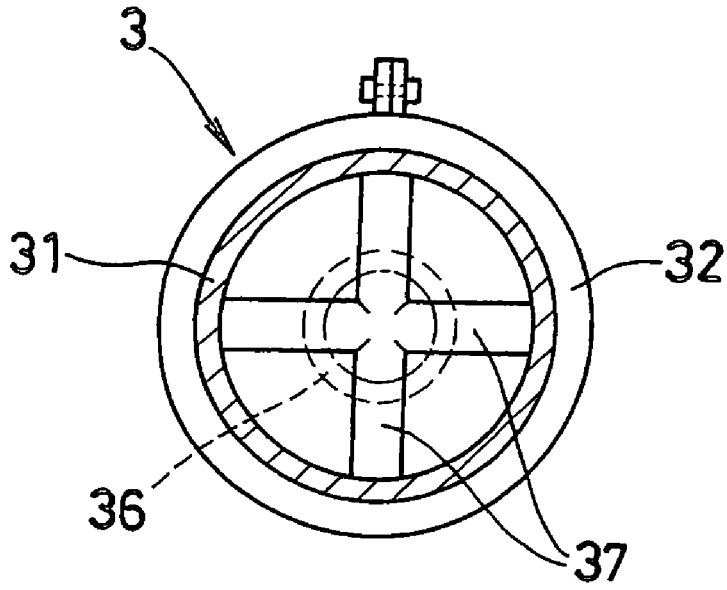
FIG. 6 is a cross-sectional plan view of the melting cylinder in a case where a plurality of auxiliary heating members are provided laterally cross on a bottom portion.

The auxiliary heating member 37 is not limited to one but, although omitted from drawing, a plurality of auxiliary heating members may be laterally bridged in parallel with spaces. Alternatively, as shown in FIG. 6, a plurality of auxiliary heating members may be laterally bridged in a cross intersection. In this case, the cross-shaped auxiliary heating members are inserted from an upper opening of the melting cylinder 31 to a boundary of the bottom portion 35 and it is hung on a body wall of the melting cylinder 31. Further when the heating of the inside of the bottom portion with the auxiliary heating member 37 is positively performed, although omitted from drawing, the auxiliary heating member 37 is formed of a pipe body and a cartridge heater is inserted into the pipe body from a body portion of the melting cylinder 3 so that heating is performed Separately from the melting cylinder 31.

Further, at the time of insertion of the cylindrical metallic raw material M into the melting cylinder 31, it is preferred that cavities on a surface layer and impurities of oxide and the like stuck on the surface generated at casting or extrusion of the cylindrical metallic raw material M are previously removed by cutting. Oxygen of the air, which enters the oxide on the surface and cavities on the surface layer, forms a metallic oxide by heat melting of the metallic raw material to become sludge easily. This sludge is deposited in the heating holding cylinder 2 to become hindrance for molding operation or become a rejected article by mixing into a molded article. Thus, the removal of the surface layer by cutting it by about 1 to 5 mm in depth can remarkably reduce the generation of sludge.

The cylindrical metallic raw material M is inserted from an upper opening into the melting cylinder 31 heated at a preset melting temperature. The cylindrical metallic raw material M drops by self weight through, the melting cylinder to a position where a bottom surface of the cylindrical metallic raw material M comes into contact with the auxiliary heating member 37 and is received by the auxiliary heating member 37. Within the melting cylinder, radiant heat of the heating means 32 heats the body circumference and at the same time a line contact with the auxiliary heating member 37 directly heats the center of the bottom surface. When a temperature of the cylindrical metallic raw material M exceeds the solidus temperature, the cylindrical metallic raw material M is softened. Accordingly, the auxiliary heating member 37, which receives a load of the cylindrical metallic raw material M, enters the center portion of the cylindrical metallic raw material M from the bottom surface thereof. Further with the entering of the auxiliary heating member 37, the softened bottom surface of the cylindrical metallic raw material M bulges out on both sides of the auxiliary heating member 37 as shown by a hypothetical line in FIG. 4 and the auxiliary heating member 37 further enters the upper portion of the cylindrical metallic raw material M to heat the center portion thereof. Therefore, the heating of the cylindrical metallic raw material M is effectively performed together with the heating from the body circumference.

When a temperature of the cylindrical metallic raw material M exceeds the liquidus temperature by the melting cylinder 31, the metallic raw material is fully melted to be molten metal. However, in a metallic raw material in which a metal structure exhibits thixotropic properties at a temperature in a solid-liquid coexisting temperature range, eutectic crystals distributing between crystals are melted at a temperature of a solid-liquid coexisting temperature range before reaching the liquidus temperature to be in a semi-molten condition of a liquid phase and a solid phase. The melting of the cylindrical metallic raw material M precedes in a lower portion, which receives heating from both the body circumference and the center portion, prior to an upper portion of the cylindrical metallic raw material M, and the molten metal flows in a diameter-reduced outflow pipe 36 through the bottom portion 35 and is accumulated in the above-mentioned heating holding cylinder 2 as a molten metal M1 in semi-molten state, which exhibits thixotropic properties. As an amount of the melt is increased, the molten metal M1 flows down through the outflow pipe 36 while being accumulated in the bottom portion 35.

Since a distribution condition of the eutectic crystal is not uniform in a metallic raw material of a metal structure exhibiting thixotropic properties, the melting conditions are also various and the melting is not uniformly performed and a small melt lump can drops from the metallic raw material M. However, since the heated funnel-shaped bottom portion 35 and the outflow pipe 36 are provided at a lower portion of the auxiliary heating member 37, a molten lump is melted down on a surface of the bottom wall and while it passes through the outflow pipe 36 from the surface of the bottom wall, the lump is melted again to be fluidized. Further, when a melt reservoir is generated on the bottom portion 35, the lump sinks in the melt reservoir to be melted again. Thus even if the melt lump is generated, the melting is performed without hindrance and clogging of the outflow pipe 36 by the melt lump is not caused. Accordingly, the melting time of the metallic raw material can be reduced.

EXAMPLE

Setting condition of clearance (dimensions in mm)

Metallic raw material Magnesium alloy (AZ91D)
Linear expansion coefficient: $27.0\times10^{-6}$/K
Shape: cylindrical body
Length: 300
Material of melting cylinder: Stainless steel (SUS 304)
Linear expansion coefficient: $16.5\times10^{-6}$/K
Shape: cylindrical body Height: 610
Heating means: band heater, rating 5 kw
Heating temperature: 550° C.

| | Non-thermal expansion | Thermal expansion |
|---|---|---|
| [No. 1] | | |
| Cylindrical body Diameter | 60.0 (A) | 60.891 |
| Melting cylinder Inner Diameter | 61.0 | 61.554 (B) |
| Difference between diameter and inner diameter | 1.0 | 0.663 |
| Clearance | 0.5 | 0.331 |
| [No. 2] | | |
| Cylindrical body Diameter | 60.0 (A) | 60.891 |
| Melting cylinder Inner Diameter | 61.5 | 62.058 (B) |
| Difference between diameter and inner diameter | 1.5 | 1.167 |
| Clearance | 0.75 | 0.583 |
| [No. 3] | | |
| Cylindrical body Diameter | 60.0 (A) | 60.891 |
| Melting cylinder Inner Diameter | 62.0 | 62.536 (B) |
| Difference between diameter and inner diameter | 2.0 | 1.672 |
| Clearance | 1.0 | 0.836 |
| [No. 4] | | |
| Cylindrical body Diameter | 60.0 (A) | 60.891 |

-continued

| | Non-thermal expansion | Thermal expansion |
|---|---|---|
| Melting cylinder Inner Diameter | 62.3 | 62.865 (B) |
| Difference between diameter and inner diameter | 2.3 | 1.974 |
| Clearance | 1.15 | 0.987 |
| [No. 5] | | |
| Cylindrical body Diameter | 60.0 (A) | 60.891 |
| Melting cylinder Inner Diameter | 63.0 | 63.572 (B) |
| Difference between diameter and inner diameter | 3.0 | 2.681 |
| Clearance | 1.5 | 1.340 |

From the above Table, clearances (dimension, mm) during both non-thermal expansion (1), during non-thermal expansion/thermal expansion (2), and thermal expansion/thermal expansion (3) of each example

| | (1) | (2) | (3) |
|---|---|---|---|
| [No. 1] | 0.5 | 0.777 | 0.331 |
| [No. 2] | 0.75 | 1.029 | 0.583 |
| [No. 3] | 1.0 | 1.252 | 0.836 |
| [No. 4] | 1.15 | 1.433 | 0.987 |
| [No. 5] | 1.5 | 1.786 | 1.340 |

In this case, the clearances during non-thermal expansion/thermal expansion (2) are values of (B)−(A)/2 respectively, and these clearances become insertion clearances of the above-mentioned cylindrical body.

Time (min.) until the cylindrical metallic raw material is completely melted (liquid-phase state) at a heating temperature of 600° C.

| [No. 1] | [No. 2] | [No. 3] | [No. 4] | [No. 5] |
|---|---|---|---|---|
| 12 | 13 | 15 | 17 | 20 |

Molding Conditions

Product mass: 40 g (one shot)
Metallic raw material: Mass: 1.5 Kg (about 37 shots' part)
Molding cycle (one shot): 30 sec
Heating temperature: 600° C.
Melting time corresponding to molding cycle (37 shots× 30 sec): About 19 min.
Metal molding apparatus: FMg 3000 (produced by Nissei Plastic Industrial Co. Ltd.)

Result

In the above-mentioned example, since the example of [No. 1] has a small clearance during both thermal expansion, the heating efficiency becomes best and the melting time is about 12 min. However, since the clearance during non-thermal expansion/thermal expansion when the cylindrical body in a non-thermal expansion state is inserted into the melting cylinder, is 0.77 mm, smaller than about 0.8 mm, which is regarded as an insertion limit, the example of [No. 1] cannot be applied.

Further, since the example of [No. 5] has a large clearance during both thermal expansion, the above-cylindrical body in a non-thermal expansion state can be easily inserted into the melting cylinder, but a clearance during non-thermal expansion/thermal expansion also becomes large in proportion to it, the heating efficiency is bad and melting of the material requires even about 20 min. Thus the all amounts of the material of [No. 5] cannot be melted for melting time (about 19 min.) corresponding to the above-mentioned molding cycle. Therefore since supply of the cylindrical body for the example of [No. 5] cannot be stably performed to the heating holding cylinder, it cannot be applied.

In the example of [No. 2], although the clearance between the cylindrical body and the melting cylinder during both non-thermal expansion is 0.75 mm, which is smaller than the above-mentioned insertion limit, the clearance during non-thermal expansion/thermal expansion is increased to 1.029 mm larger than the insertion limit. Therefore, the cylindrical body can be inserted into the melting cylinder. Further, since the melting time (13 min.) is within the melting time (about 19 min.) corresponding to the above-mentioned molding cycle, the example of [No. 2] can be applied. However, since the example of [No. 2] is liable to be affected by adhesion of oxide generated on an inner surface of the melting cylinder during long time use, cleaning of the adhesion is required every constant period of time.

In the example of [No. 3], since the clearance during non-thermal expansion/thermal expansion is formed to be 1.252 mm larger than in the example of [No. 2], the insertion of the cylindrical body into the melting cylinder becomes easy. Further, since the melting time (15 min.) is within the melting time (about 19 min.) corresponding to the above-mentioned molding cycle and a clearance is sufficiently ensured, the influence due to adhesion of oxide in case of [No. 2] is not liable to be exerted. Therefore no cleaning is required for a long period of time and the insertion of the cylindrical body and melting of the metallic raw material are made possible in a most preferable condition.

In the example of [No. 4], since the clearance during non-thermal expansion/thermal expansion is formed to be 1.433 mm larger than in the example of [No. 3], the insertion of the cylindrical body into the melting cylinder becomes easy. Further, since an influence due to adhesion of oxide is not exerted, no cleaning is required. However, it takes much melting time due to a reduction of heating efficiency. However, since the melting time (17 min.) of all amounts of the metallic raw material is within the melting time (about 19 min.) corresponding to the above-mentioned molding cycle, a case near the example of [No. 4] is within an applicable range.

Therefore it is apparent from the examples [No. 2] to [No. 4] that if a clearance is set at a range, which does not exceed 1.0 mm with respect to an inner diameter D of a melting cylinder and a diameter d of a cylindrical metallic raw material during thermal expansion, the insertion of the above-mentioned cylindrical metallic raw material into the melting cylinder can be smoothly made and the melting of the metallic raw material within melting time corresponding to the molding cycle becomes possible from a linear expansion coefficient of the metallic raw material and a linear expansion coefficient of the material of the melting cylinder, and that a substantial inner diameter of the melting cylinder is set under non-thermal expansion conditions and easiness of the insertion of the cylindrical metallic raw material in the metal molding apparatus and efficient melting of the metallic raw material are made in a compatible manner.

Further, in a case where a bottom portion of the melting cylinder is formed into a funnel shape, a bottom surface of the cylindrical metallic raw material is partially supported by a laterally provided auxiliary heating member, both ends of which are fixed to a body wall in a lower portion of the body portion adjacent to the bottom portion of the melting cylinder, and both the body circumference and the bottom surface in the cylindrical metallic raw material are simultaneously heated, the heating efficiency was further improved and the melting time could be reduced.

INDUSTRIAL APPLICABILITY

The difficulty and heating efficiency on the insertion of a cylindrically formed metallic raw material into a melting cylinder in a metal molding apparatus could be solved by a process of setting a clearance. Thus, it is advantageous that continuous molding of metallic products can be performed without use of a melting furnace while directly melting the metallic raw material with a simple melting cylinder to supply the molten metal to a metal molding apparatus.

The invention claimed is:

1. A method for melting a metallic raw material in a metal molding apparatus comprising the steps of forming the metallic raw material into a cylindrical shape by casting or extrusion, inserting said cylindrical metallic raw material as a molding material into a melting cylinder provided vertically in a heating holding cylinder in said metal molding apparatus from above, and semi-melting or completely melting said cylindrical metallic raw material by a heating means set around said melting cylinder, wherein a clearance between an inner circumferential surface of said melting cylinder and an outer circumferential surface of said cylindrical metallic raw material is previously set to a range in which said clearance does not exceed 1.0 mm with respect to an inner diameter of said melting cylinder and a diameter of said cylindrical metallic raw material during thermal expansion and said clearance allows an insertion of said cylindrical metallic raw material in a non-thermal expansion state into said melting cylinder thermally expanded at the temperature of said heating means, said diameters being calculated from a linear expansion coefficient of a metallic raw material and a linear expansion coefficient of a metallic material of the melting cylinder; and wherein said melting cylinder is comprised of a funnel-shaped bottom portion connecting to a body portion of the melting cylinder, an outflow pipe having a smaller diameter than the body portion at the center of the bottom portion, an auxiliary heating member provided laterally in a lower portion of the body portion adjacent to the bottom portion of said melting cylinder, both ends of said auxiliary heating member being fixed to a body wall, and a heating means provided on the body portion and on an outer circumference of said outflow pipe, and the melting of said metallic raw material is performed by simultaneously heating of both radiant heat of the body circumference and contact heating of the bottom surface of the metallic raw material, by supporting partially the bottom surface of said cylindrical metallic raw material with the auxiliary heating member.

2. The method for melting a metallic raw material in a metal molding apparatus according to claim 1, wherein said melting cylinder is made of a metallic material having a linear expansion coefficient smaller than a linear expansion coefficient of said metallic raw material.

3. The method for melting a metallic raw material in a metal molding apparatus according to claim 1, wherein said auxiliary heating member is provided laterally at the center of a lower portion of the body portion of said melting cylinder adjacent to the bottom portion thereof so that the bottom surface of said cylindrical metallic raw material is partially supported.

4. The method for melting a metallic raw material in a metal molding apparatus according to claim 1, wherein a plurality of said auxiliary heating members are provided laterally across the center in a lower portion of the body portion adjacent to the bottom portion of said melting cylinder so that the bottom surface of said cylindrical metallic raw material is partially supported.

5. The method for melting a metallic raw material in a metal molding apparatus according to claim 1, wherein a heating means is provided within said auxiliary heating member and the center portion of said cylindrical metallic raw material is directly heated from a bottom surface thereof by contact between said auxiliary heating member and the bottom surface of said cylindrical metallic raw material.

6. The method for melting a metallic raw material in a metal molding apparatus according to any one of claims 1 and 2 to 5, wherein said metallic raw material is made of a low melting metal alloy selected from the group consisting of:

a magnesium alloy, and an aluminum alloy.

7. The method for melting a metallic raw material in a metal molding apparatus according to claim 6, wherein said metallic raw material is composed of a magnesium alloy exhibiting thixotropic properties at a temperature in a solid-liquid coexisting temperature range.

8. The method for melting a metallic raw material in a metal molding apparatus according to claim 6, wherein the melting of said metallic raw material is performed after cutting and removing cavities generated in a surface layer of the cylindrical metallic raw material and impurities adhered to a surface of the material.

9. The method for melting a metallic raw material in a metal molding apparatus according to claim 1, wherein said melting cylinder is made of a metallic material having a linear expansion coefficient smaller than a linear expansion coefficient of said metallic raw material.

10. The method for melting a metallic raw material in a metal molding apparatus according to claim 3, wherein a heating means is provided within said auxiliary heating member and the center portion of said cylindrical metallic raw material is directly heated from a bottom surface thereof by contact between said auxiliary heating member and the bottom surface of said cylindrical metallic raw material.

11. The method for melting a metallic raw material in a metal molding apparatus according to claim 4, wherein a heating means is provided within said auxiliary heating member and the center portion of said cylindrical metallic raw material is directly heated from a bottom surface thereof by contact between said auxiliary heating member and the bottom surface of said cylindrical metallic raw material.

12. The method for melting a metallic raw material in a metal molding apparatus according to claim 7, wherein the melting of said metallic raw material is performed after cutting and removing cavities generated in a surface layer of the cylindrical metallic raw material and impurities adhered to a surface of the material.

* * * * *

UNITED STATES PATENT AND TRADEMARK OFFICE

CERTIFICATE OF CORRECTION

PATENT NO. : 7,331,372 B2
APPLICATION NO. : 10/549429
DATED : February 19, 2008
INVENTOR(S) : Kiyoto Takizawa et al.

It is certified that error appears in the above-identified patent and that said Letters Patent is hereby corrected as shown below:

Column 8, line 15, " Sepa- " should read -- sepa- --; and

Signed and Sealed this

Twenty-sixth Day of May, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,331,372 B2
APPLICATION NO. : 10/549429
DATED : February 19, 2008
INVENTOR(S) : Kiyoto Takizawa et al.

It is certified that error appears in the above-identified patent and that said Letters Patent is hereby corrected as shown below:

Column 13, line 20, to Column 14, line 29, delete claims 6 through 12, and insert the following claims 6 through 12 reordered:

--6. The method for melting a metallic raw material in a metal molding apparatus according to claim 1, wherein said melting cylinder is made of a metallic material having a linear expansion coefficient smaller than a linear expansion coefficient of said metallic raw material.

7. The method for melting a metallic raw material in a metal molding apparatus according to claim 3, wherein a heating means is provided within said auxiliary heating member and the center portion of said cylindrical metallic raw material is directly heated from a bottom surface thereof by contact between said auxiliary heating member and the bottom surface of said cylindrical metallic raw material.

8. The method for melting a metallic raw material in a metal molding apparatus according to claim 4, wherein a heating means is provided within said auxiliary heating member and the center portion of said cylindrical metallic raw material is directly heated from a bottom surface thereof by contact between said auxiliary heating member and the bottom surface of said cylindrical metallic raw material.

9. The method for melting a metallic raw material in a metal molding apparatus according to any one of claims 1 to 8, wherein said metallic raw material is made of a low melting metal alloy selected from the group consisting of:

a magnesium alloy, and
an aluminum alloy.

UNITED STATES PATENT AND TRADEMARK OFFICE

CERTIFICATE OF CORRECTION

PATENT NO. : 7,331,372 B2
APPLICATION NO. : 10/549429
DATED : February 19, 2008
INVENTOR(S) : Kiyoto Takizawa et al.

It is certified that error appears in the above-identified patent and that said Letters Patent is hereby corrected as shown below:

10. The method for melting a metallic raw material in a metal molding apparatus according to claim 9, wherein said metallic raw material is composed of a magnesium alloy exhibiting thixotropic properties at a temperature in a solid-liquid coexisting temperature range.

11. The method for melting a metallic raw material in a metal molding apparatus according to claim 9, wherein the melting of said metallic raw material is performed after cutting and removing cavities generated in a surface layer of the cylindrical metallic raw material and impurities adhered to a surface of the material.

12. The method for melting a metallic raw material in a metal molding apparatus according to claim 10, wherein the melting of said metallic raw material is performed after cutting and removing cavities generated in a surface layer of the cylindrical metallic raw material and impurities adhered to a surface of the material.--

Signed and Sealed this

Eleventh Day of August, 2009

David J. Kappos

David J. Kappos
*Director of the United States Patent and Trademark Office*